United States Patent [19]

Michele

[11] Patent Number: 4,679,621

[45] Date of Patent: Jul. 14, 1987

[54] SPIRAL HEAT EXCHANGER

[75] Inventor: Jurgen Michele, Schortens, Fed. Rep. of Germany

[73] Assignee: Paul Grote, Friedrichsfehn, Fed. Rep. of Germany

[21] Appl. No.: 831,927

[22] Filed: Feb. 20, 1986

[30] Foreign Application Priority Data

Feb. 20, 1985 [DE] Fed. Rep. of Germany ..... 3505789

[51] Int. Cl.[4] ..... F28D 7/02

[52] U.S. Cl. ..... 165/145; 165/165

[58] Field of Search ..... 165/164, 165, 170, 145

[56] References Cited

U.S. PATENT DOCUMENTS

| | | | |
|---|---|---|---|
| 1,758,209 | 5/1930 | Wilson | 165/143 |
| 2,011,201 | 8/1935 | Rosenblad | 165/165 |
| 2,039,556 | 5/1936 | Ruse | 165/145 X |
| 2,131,265 | 9/1938 | Bichowsky | 165/165 |
| 2,136,153 | 11/1938 | Rosenblad | 165/165 |
| 3,854,530 | 12/1974 | Jouet et al. | 165/165 X |
| 3,921,713 | 11/1975 | Schwitzer et al. | 165/164 |
| 4,577,683 | 3/1986 | Kelcb | 165/164 |

FOREIGN PATENT DOCUMENTS

| | | | |
|---|---|---|---|
| 48949 | 7/1934 | Denmark | 165/165 |
| 0989295 | 1/1983 | U.S.S.R. | 165/165 |

*Primary Examiner*—Albert W. Davis, Jr.
*Assistant Examiner*—Randolph A. Smith
*Attorney, Agent, or Firm*—Collard, Roe & Galgano

[57] ABSTRACT

A recuperative or restorative spiral heat exchanger with separating walls spirally extending between fluid streams of medium having an exploitable temperature gradient. Each two adjacent separating walls enclose between themselves a flow duct for one of the two streams of medium and the spiral space between two flow ducts forms the path of flow for the other stream of medium. The spiral is provided in the form of a multiple or multi-channel spiral by arranging a plurality of flow ducts. In particular, the spiral heat exchanger consists of two multiple spirals with opposed directions of current.

3 Claims, 1 Drawing Figure

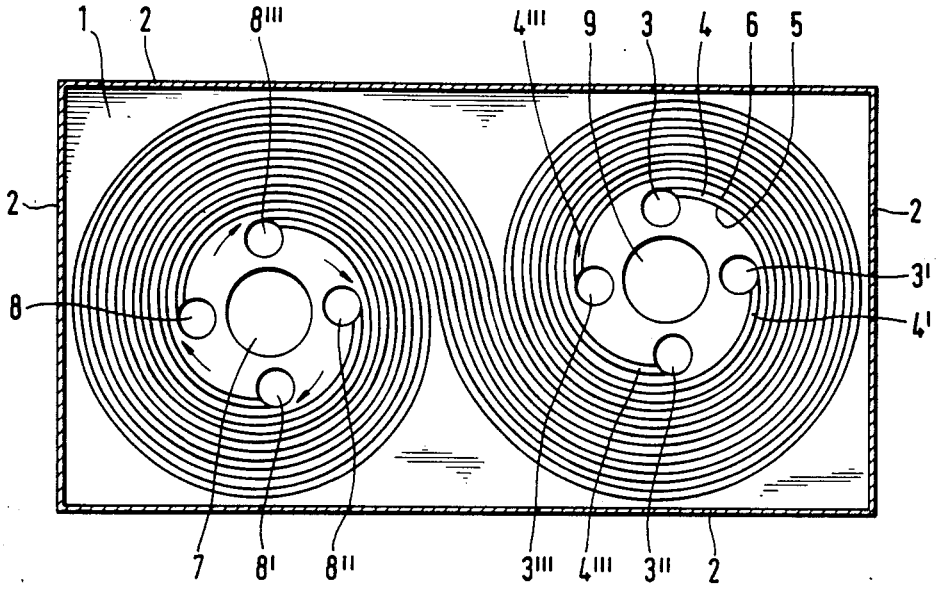
1
2
8'''
4'''
9
3
4
6
5
2
2
3'
8
4'
7
8'
8''
3'''
4'''
3''
2

SPIRAL HEAT EXCHANGER

BACKGROUND OF THE INVENTION

The invention relates to a spiral heat exchanger. More particularly, it relates to a restorative or recuperative spiral heat exchanger with spirally extending separating walls between streams of fluid medium having an exploitable temperature gradient. It especially relates to such a heat exchanger wherein each two adjacent separating walls enclose between themselves a flow duct for one of the two streams of medium, and the spiral space disposed between two flow ducts forms the path of flow for the other stream of medium.

Spiral heat exchangers are known, and such heat exchangers with spirally arranged flow ducts may be advantageously operated by the countercurrent or counterflow heat exchange principle, which permits large areas of heat exchange surface in a small space. However, a spiral heat exchanger has the drawback that the flow paths are relatively long because they are disposed in a spiral, which leads to high pressure losses. Furthermore, extensive flow paths make it more difficult to securely seal the heat exchanger. The cleaning of such heat exchangers also poses problems, and their operation with higher pressure differences requires an above-average expenditure in terms of engineering and constructions. These drawbacks are the reasons why spiral heat exchangers, until now, have failed to find wide acceptance in the market.

Accordingly, it is an object of the invention to provide a spiral heat exchanger wherein the above-identified drawbacks are eliminated.

SUMMARY OF THE INVENTION

The foregoing and related objects are readily attained according to the invention in a spiral heat exhanger having a multi-channel spiral composed of a multiplicity of spirally-extending spaced-apart separating walls, each adjacent pair of which define a flow duct therebetween used in an alternate fashion for one of two oppositely flowing streams of medium.

The separating walls may form two interconnected multiple wall spirals having opposed directions of spiral, which are arranged in a closed housing. Most desirably, the flow ducts include inflow and outflow openings with the inflow openings disposed in the housing approximately at the center of one of the spirals, and the outflow openings disposed in the housing approximately at the center of the other spiral. Each spiral is advantageously formed from strips of bended sheet metal placed on edge next to each other. The two spirals may also form substantially S-shaped flow ducts.

By providing the spiral in the form of a multiple or multi-channel spiral via suitably arranging a plurality of flow ducts, each stream of medium can be distributed to the channels of the spiral, providing the advantage that the spiral-shaped flow ducts between the inflow and outflow of each stream of medium are relatively short. Accordingly, this permits a higher through-put or flow rate. These two advantages are achieved or realized without reducing the actual area of heat exchange, whose dimension or size, in an obtainable or "realizable" order of magnitude, has to be adapted to the rating of a heat exchanger. Thus, a spiral heat exchanger designed according to the invention, due to the given area of heat exchange, is capable of supplying the full capacity for which it is designed without incurring the disadvantages of spiral heat exchangers of the conventional type of design.

Furthermore, a heat exchanger designed with a multiple spiral has the advantage that it can be manufactured in a simple way because the individual flow ducts are relatively short. This means that shaping or manufacturing of the separating walls by bending them into the spiral shape is simple as well, because the individual windings are disposed within each other only to a minor extent. In addition, in a preferred embodiment of the invention, the spiral heat exchanger is improved further in that it consists of two multiple spirals having opposed directions of spiral. This design permits a further reduction of the design dimensions of the spirals, and relatively large heat exchange areas can therefore be accommodated within a very small space. Each flow duct or channel within one of the spirals can be even shorter because the total length of each flow duct can be predetermined by its course within the two spirals. By connecting two countercurrently operating spirals, each flow duct is provided with an approximately S-shaped course, wherein the S-bends are disposed within one of the spirals. This type of spiral shaping of the heat exchanger areas facilitates their manufacture and permits a relatively low-cost fabrication. Preferably, the spirals are shaped by bending, for example, from strips of sheet metal placed on edge next to each other. Each two strips of sheet metal enclose a flow duct between themselves, which is closed at the top and bottom by a cover, for example, by the outer walls of the housing. Therefore, both spirals may be advantageously arranged in a simple way in a closed housing, which makes the heat exchanger an especially compact component satisfying high performance requirements. Its application is feasible in air-conditioning systems or in other fields, in particular, in the field of low waste- or off-heat temperatures in connection with gases.

In each case, the inflow and outflow openings are arranged in a zone of the housing conforming to the center of the spirals. Line connections, for example short connection pipes, may be provided as required.

Other objects and features of the present invention will become apparent from the following detailed description considered in connection with the accompanying drawing which discloses one embodiment of the invention. It is to be understood, however, that the drawing is designed as an illustration only and not as a definition of the limits of the invention.

BRIEF DESCRIPTION OF THE DRAWING

The drawing is a schematical sectional view of a spiral heat exchanger embodying the present invention.

DETAILED DESCRIPTION OF THE PREFERRED EMBODIMENT

Turning now in detail to the appended drawing, therein illustrated is a novel heat exchanger embodying the present invention, which basically includes a housing having a bottom wall 1 and box-shaped sidewalls 2. In this embodiment, the heat exchange areas are arranged in the shape of a spiral as shown in the drawing. A stream of a first medium can be fed via the inflow openings 3–3'''. Since four inflow openings are provided and one flow duct 4–4''' is connected to each of the inflow openings 3–3''', respectively, the stream of first medium is distributed to the four flow ducts. Each flow duct is defined or delimited by two adjacently disposed separating walls, e.g., 5, 6, which in the present case are identified in the drawing for flow duct 4. Flow ducts 4–4''' are placed or nested into each other in the shape of a spiral and thus form a multiple spiral with a clockwise winding or course. As the flow ducts 4–4''' are independent, each can carry a different medium, if desired. Free or open spiral spaces are disposed between individual flow ducts 4–4''', and serve as flow ducts for a second stream of medium.

The second medium stream is fed by way of one single infeed opening 7 which has a larger diameter and is arranged in the left spiral, which is wound counterclockwise. The second medium stream passes through the channels and exits via opening 9. The first stream of medium which enters by way of the inflow openings 3–3''' of the right or first spiral, is discharged through left or second spiral via outflow openings 8–8'''. Thus, outflow opening 8 is disposed at the end of flow duct 4 branching from inflow opening 3. The remaining associated inflow and outflow openings 3'–3''' and 8'–8''', respectively, have a similar correspondence.

The second stream of medium admitted by way of larger inflow opening 7 in the left-hand spiral enters the zones (schematically indicated by arrows) in the spiral spaces between the flow ducts and streams through the spiral spaces to the right-hand spiral. Thus, the second medium flows countercurrently with respect to the stream of the first medium fed into the right-hand spiral, and the second medium exits from the housing of the heat exchanger by way of outflow opening 9 provided in the right-hand spiral.

Thus, while only a single embodiment of the present invention has been shown and described, it will be obvious that many changes and modifications may be made thereunto without departing from the spirit and scope of the invention.

What is claimed is:

1. A recuperative spiral heat exchanger, comprising:

two interconected multi-channel spirals having opposed directions of spirals and composed of a multiplicity of spirally-extending, spaced-apart separating walls, each adjacent pair of which define a flow duct therebetween used in an alternate fashion for one of two oppositely flowing streams of medium, said two spirals together forming substantially S-shaped flow ducts lying substantially in the same plane, a closed housing in which said two spirals are arranged, and inflow and outflow openings for said flow ducts, said inflow openings being disposed in said housing approximately at the center of one of said spirals and said outflow openings being disposed in said housing approximately at the center of said other spiral.

2. The head exchanger as defined in claim 1, wherein each spiral is formed from strips of bended sheet metal placed on edge next to each other.

3. The heat exchanger as defined in claim 1, further comprising an inlet and an outlet disposed in said housing.

* * * * *